US005164292A

United States Patent [19]

Johnson et al.

[11] Patent Number: 5,164,292

[45] Date of Patent: Nov. 17, 1992

[54] SELENIUM AND IRIDIUM DOPED EMULSIONS WITH IMPROVED PROPERTIES

[75] Inventors: Brian R. Johnson, Webster; Philip J. Wightman, Rochester, both of N.Y.

[73] Assignee: Eastman Kodak Company, Rochester, N.Y.

[21] Appl. No.: 634,633

[22] Filed: Dec. 27, 1990

[51] Int. Cl.[5] ..... G03C 1/09

[52] U.S. Cl. ..... 430/569; 430/603; 430/605

[58] Field of Search ..... 430/608, 605, 603, 569

[56] References Cited

U.S. PATENT DOCUMENTS

| | | | |
|---|---|---|---|
| 4,035,185 | 7/1977 | Evans et al. | 430/569 |
| 4,147,542 | 4/1979 | Habu et al. | 430/346 |
| 4,173,483 | 11/1979 | Habu et al. | 430/575 |
| 4,439,520 | 3/1984 | Kofron et al. | 430/434 |
| 4,444,865 | 4/1984 | Silverman et al. | 430/217 |
| 4,693,965 | 9/1987 | Ihama et al. | 430/605 |
| 4,828,962 | 5/1989 | Grzeskowiak et al. | 430/230 |
| 4,997,751 | 3/1991 | Kim | 430/605 |

FOREIGN PATENT DOCUMENTS

| | | |
|---|---|---|
| 2611037 | 10/1976 | Fed. Rep. of Germany . |
| 63-292126 | 1/1986 | Japan . |
| 62-178235 | 5/1987 | Japan . |
| 1527435 | 10/1978 | United Kingdom . |

OTHER PUBLICATIONS

Research Disclosure #308119, Dec. 1989, pp. 993-1015.

*Primary Examiner*—Charles L. Bowers, Jr.
*Assistant Examiner*—Mark F. Huff
*Attorney, Agent, or Firm*—Paul A. Leipold

[57] ABSTRACT

The invention is generally accomplished by forming a silver halide emulsion and during precipitation adding iridium and selenium in an amount effective to decrease reciprocity failure with substantially no decrease in speed. In a preferred form, a photographic element is formed comprising of bromoiodide emulsion having about 3 to about 88 nanograms of iridium per square meter of silver halide grain surface area and about 42 to about 487 nanograms of selenium per square meter of silver halide grain surface area. It is also preferred that the iridium and selenium be added at a point after the precipitation has proceeeded to a point wherein at least half of the silver to be added is present.

28 Claims, No Drawings

SELENIUM AND IRIDIUM DOPED EMULSIONS WITH IMPROVED PROPERTIES

TECHNICAL FIELD

The present invention relates to the manufacture of silver halide emulsions for photographic use. It more particularly relates to doping of such emulsions during crystal growth.

BACKGROUND ART

Generally, silver halide emulsion are prepared through the process of forming of silver halide grains by bringing together a soluble silver salt with a soluble halide in an aqueous gelatin solution and then conducting a physical ripening process, a desalting process, and a chemical ripening process of the resulting emulsion. Spectral sensitizing dyes and chemical sensitizing agents are also generally added to the emulsion prior to its utilization in a photographic element.

Tabular silver bromide and bromoiodide emulsions generally have come into use for higher speed color negative and black and white film applications. Formation of these emulsions generally involves a controlled ripening step immediately after nucleation whereby twin planes are formed resulting in tabular crystals which increase in size during the growth step. Such processes have been described in U.S. Pat. No. 4,433,048—Solberg and U.S. Pat. No. 4,439,520—Kofron et al. It is known that various metals such as copper, thallium, lead, mercury, bismuth, zinc, cadmium, rhenium, and group VIII metals such as iron, ruthenium, rhodium, palladium, osmium, iridium, and platinum can be present during precipitation of a silver halide emulsion. Further, it is known that such materials may be added after emulsion formation during sensitization. Reference is made in *Research Disclosure* 308119, Section I, for listing of metals that may be utilized in emulsion formation. Section 111 of that same disclosure deals with sensitization and also lists a similar group of metals as available for sensitization.

While it has been known that a variety of metals have effect upon silver halide emulsion properties, the use of these metals in ways such as to obtain improved products in a consistent manner remains of interest. It is known that some of these additives will improve reciprocity, but cause a loss in speed. Others may improve speed but cause a loss in long exposure reciprocity properties. Further, the metals sometimes have different properties depending upon where in the emulsion forming or the sensitization process they are added. Further, many of the changes brought about to the properties are dependent upon the quantity of the metal added, as well as when in the forming process it is added. There is a need to determine the most effective ways of using these materials.

DISCLOSURE OF INVENTION

It is the object of the invention to produce improved photographic materials.

It is another object of the invention to improve film reciprocity properties without deteriorating speed properties.

These and other objects of the invention are generally accomplished by forming a silver halide emulsion and during precipitation adding iridium and selenium in an amount effective to decrease reciprocity failure with substantially no decrease in speed. In a preferred method, the iridium and selenium are added at a point during precipitation after at least half of the silver to be added is present. In a preferred form, a photographic element is formed comprising of silver bromoiodide emulsion having about 3 to about 88 nanograms of iridium per square meter of silver halide grain surface area and about 42 to about 487 nanograms of selenium per square meter of silver halide surface area.

MODES FOR CARRYING OUT THE INVENTION

The invention has numerous advantages over prior emulsions and photographic materials. The emulsions of the invention, when improved by the use of the iridium and selenium added in accordance with the invention, exhibit reduced reciprocity failure while not having significantly decreased speed. Further, the emulsions have reduced pressure sensitivity.

The invention may be utilized with any silver halide emulsion. Typical of such emulsions are cubo-octahedral emulsions, cubic emulsions, and tabular emulsions. The invention further may be practiced with a variety of silver halide emulsions including iodide, bromide, and chloride emulsions. The invention is preferred for use with bromoiodide tabular emulsions, as these materials are used in higher speed color negative films where improvement in reciprocity, as well as improvement in pressure desensitization properties, are desired. The iridium and selenium may be added at any time in the formation of the silver halide grains of the invention. Typically, the iridium is added after about 50 to 95 percent of the weight of silver has been added to the emulsion during growth of the silver halide grains. It is preferred to add the iridium after about 70 percent of the silver weight has been added for production of grains with the best properties. It is believed to be best to add the selenium after the iridium. It is believed that the selenium addition may be carried out much nearer the end of the making of the emulsion than is possible for addition of the iridium which must be earlier doped into the emulsion. Generally, however, it is preferred that the selenium is added immediately subsequent to iridium addition for best grain performance.

The amount of selenium added is whatever amount is required to give speed maintenance in spite of the iridium addition. A suitable amount is between about 42 nanograms and about 487 nanograms selenium per square meter of grain surface. A preferred amount of selenium is between about 84 and about 244 nanograms for best speed maintenance.

The iridium may be added in any amount to give the desired reciprocity and is generally proportional to the surface area of the silver halide grains of the emulsion. A suitable amount is between about 3 and about 88 nanograms iridium per square meter of grain surface. A preferred amount is between about 6 and about 44 nanograms iridium per square meter of grain surface in order to give the desired reciprocity for color negative films utilizing tabular grains.

The invention may be utilized with any type of silver halide grain morphology. Cubic and octahedral morphologies are typical examples. Preferred for the invention are emulsions of greater than 70% of tabular grains of a ratio of diameter to thickness typically greater than 8 most and preferably greater than 12. The preferred silver halide tabular grains are preferably silver bromoiodide grains of greater than 88% silver bromide, preferably greater than 94% silver bromide.

Any desired materials may be utilized as a medium for addition of the iridium, generally, the iridium is added by way of an appropriate salt. Typical of such materials are potassium bromochloride salts such as $K_3IrCl_6$ and $K_3IrBr_6$. A preferred material has been found to be a potassium chloro iridium salt $K_2IrCl_6$ as it is a more stable salt.

Selenium may be introduced by any suitable means. Typically it is introduced as a salt. Typical of such selenium salts are KSeCN and dimethylselenourea. A preferred selenium salt is potassium selenocyanate (KSeCN) as it is stable and can be obtained in pure form.

It is preferred that the pBr of the emulsion during ripening and growth stage be well above the pBr of the reaction vessel during nucleation.

Modyifying compounds can be present during silver bromide and silver bromoiodide precipitation. Such compounds can be initially in the reaction vessel or can be added along with one or more of the salts according to conventional procedures. Modifying compounds such as compounds of sulfur, selenium, and gold, as well as other modifying compounds, are disclosed in *Research Disclosure* 22534. Jan. 1983.

Vehicles, which include both binders and peptizers, can be chosen from among those conventionally employed in silver halide emulsions. Preferred peptizers are hydrophilic colloids, which can be employed alone or in combination with hydrophobic materials. Suitable hydrophilic materials include substances such as proteins, protein derivatives, cellulose derivatives, and the preferred gelatin derived from cattle bone, hide. Or pigskin. Such vehicles are well known and are also disclosed in the Research Disclosures above set forth.

The silver halide grains of the present invention are preferably washed to remove soluble salts Conventional washing procedures, such as those disclosed in *Research Disclosure* 17643, Vol. 176, Dec. 1978, II, herein incorporated by reference are contemplated.

Photographic emulsions can contain brighteners, antifoggants, stabilizers, scattering absorbing materials, hardeners, coating aids, plasticizers, lubricants, and matting agents such as described in Item 17643. Paragraphs 5, 6, 7, 8, 10, 11, 12, and 16. Conventional photographic supports also can be employed and are described in paragraph 17 of Item 14643.

EXAMPLES

The following examples are intended to be illustrative and not exhaustive of the invention. Parts and percentages are by weight unless otherwise noted.

Example 1 (Control)

This emulsion formula will act as the control since it contains neither a selenium nor an iridium source. This formula will yield a 4.3 mole percent iodide tabular grain emulsion approximately 2.4 μm in median diameter and 0.105 μm in median thickness. The iodide in the emulsion is introduced via a 1.5 mole percent run potassium iodide phase and a 3 mole percent dump silver iodide phase.

(1) Reactor: 70° C. 5.25 L distilled water, 2g/L DI(deionized) gelatin. 6g/L NaBr, 0.19 cc/L NALCO 2341, (antifoamant—85% paraffin oil, with polyethylene glycol alkyl esters, and dispersed bis-stearamide and amorphous silica solids)

(2) Nucleation: Single jet, 50 cc/min. for 2 min. using 0.55 M $AgNO_3$ (3) Ammonia Addn.: Add 25 cc of 3 M $NH_4OH$, segment time 1.5 min.

(4) Growth 1: Double-jet flow using 0.55 M $AgNO_3$ at 50 cc/min. and a salt solution consisting of 0.59 M NaBr and 0.009 M KI at 54 cc/min. Over 2 min.

(5) pH Adjust: Add 18.5 cc of 4N $HNO_3$ to lower pH to 6.0 range (6) Dilution: 70 g/L gelatin, 0.125 cc/L NALCO 2341 brought to 2000 cc with distilled water is added to the reactor (7) growth 2: Double jet flow using 0.55 M $AgNO_3$ at 87 cc/min. and a salt solution consisting of 0.59 M NaBr and 0.009 M KI at 95 cc/min. for 10 min.

(8) Growth 3-6: Double-jet flow using 2.75 M $AgNO_3$ and a salt solution consisting of 2.955 M NaBr and 0.045 M KI with vAg control at 1.52 pBr

| Growth Segment | Ag Flow (cc/min) | Salt Flow (cc/min) | Time (min) |
|---|---|---|---|
| 3 | 17.5-38.7 | 15.9-35.8 | 10 |
| 4 | 38.7-70.2 | 37.4-67.0 | 10 |
| 5 | 70.2-112.4 | 67.1-106.8 | 10 |
| 6 | 112.4 | 106.8 | 9.45 |

Salt Dump: 475 g/L NaBr, 11.8 g/L KI, brought to 375 cc with distilled water, segment time 2 min.

(10) AgI Seed Dump: 0.439 M AgI seeds, dump volume 821 cc, segment time 2 min.

(11) Silver overrun: Double jet flow using 2.75 M $AgNO_3$ at 60 cc/min. and 3.0 M NaBr to control at 2.38 pBr over 20.3 min.

(12) Wash: Cool to 40° C. and wash to 3.56 pBr concentrate, add DI(deionized) gelatin to 60 g/Ag mole, chill set and store.

Example 2 (Control)

Similar to Example 1, except that this emulsion contains iridium introduced as $K_{21}rCl_6$ at a level of 33 ng $Ir/m^2$ prior to the salt dump (9). Also, Growth 6 time shortened.

(8) Growth 6: Segment time 8 minutes (8.5) Iridium Addn.: Double jet flow similar to Growth 6 with the addition of a third stream containing $K_2IrCl_6$ at 12 mg/L. Add 50 cc of the iridium solution over 1.45 minutes

Example 3 (Control)

Similar to Example 2, except that the Ir level is reduced to 8.3 nb $Ir/m^2$ (8.5) Iridium Addn.: Add 12.5 cc of the iridium solution over 1.45 minutes

Example 4 (Control)

Similar to Example 1, except this formula introduces selenium in the form of KSeCN at a level of 184 ng $Se/m^2$ prior to the AgI seed dump (9.5) Selenium Addn.: Dilute 14.2 cc of a 0.17 g/L KSeCN solution to 250 cc with distilled water and add to reactor

Example 5 (Invention)

Similar to Example 2, except this formula introduces selenium in the form of KSeCN at a level of 184 ng $Se/m^2$ prior to the AgI seed dump (9.5) Selenium Addn.: Dilute 14.2 cc of a 0.17 g/L KSeCN solution to 250 cc with distilled water and add to kettle Example 6 (Invention)

Similar to Example 3, except this formula introduced selenium in the form of KSeCN at a level of 184 ng Se/m$^2$ prior to the AgI seed dump (9.5) Selenium Addn.: Dilute 14.2 cc of a 0.17 g/L KSeCN solution to 250 cc with distilled water and add to reactor Each of the emulsion examples were sensitized by melting at 40° C. adding NaSCN at 125 mg/Ag mole, green sensitizing dye at 65%–80% saturation coverage in a 3:1 ratio of Dye A:Dye B Dye A

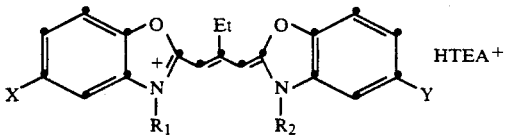

$R_1, R_2 = (CH_2)_3SO_3^-, (CH_2)_2\overset{CH_3}{\overset{|}{C}}HSO_3^-$

X = Cl Y = 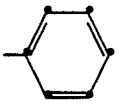

HTEA = $(CH_3CH_2—)_3NH_4^+$

Dye B

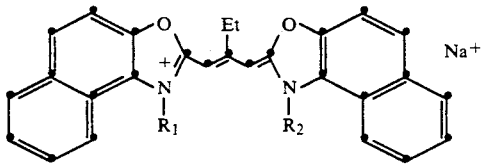

-continued $R_1, R_2 = (CH_2)_3SO_3^-$

Adding gold sensitizer in the form of sodium aurous (I) dithiosulfate dihydrate at 1.39–1.95 mg/Ag mole. Adding sulfur sensitizer in the form of sodium thiosulfate at 0.69–0.96 mg/Ag mole. Adding benzothiazolium salt (benzothiazolium tetrafluoroborate) finish modifier at 40 mg/Ag mole and heat the melt to 65° C. Holding at 65° C. for 5 20 minutes and then chill setting.

The sensitized emulsion is combined with a coupler melt so as to lay down 200 mg/ft$^2$ gelatin, 75 mg/ft$^2$ Ag, 75 mg/ft$^2$ Coupler D, 2 mg/ft$^2$ Coupler E, and 1 g/Ag mole TAI (5-methyl-S-triazole-[2-3-a]-pyrimidine-7-ol) onto an acetate support. The acetate support includes 32 mg/ft$^2$ Ag for antihalation and a 227 mg/ft$^2$ gelatin pad. The emulsion/coupler layer is overcoated with 200 mg/ft$^2$ gelatin and bis (vinylsulfonylmethyl)-ether (BVSM) hardener at 1.75% of total gel mass. The overcoat also contains surfactants at 0.925% of total melt mass.

The film samples for pressure desensitization testing were subjected to a nominal 10,000 psi supplied by a smooth roller pressure tester before exposure. Then along with the samples for the other sensitometric tests, exposed under a 5500K light source using a wratten 9 filter and suitable neutral density filters for 1/100 second. The exposures for reciprocity testing were done at 1/1000 second and 10 seconds with appropriate filters to achieve equal exposure. The film samples were put through a C-41 developing process with a 3 minute time of development. Densitometry data was generated through the use of a transmission densitometer.

Coupler D

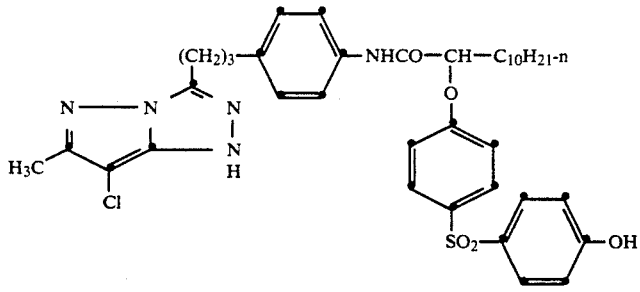

Coupler E

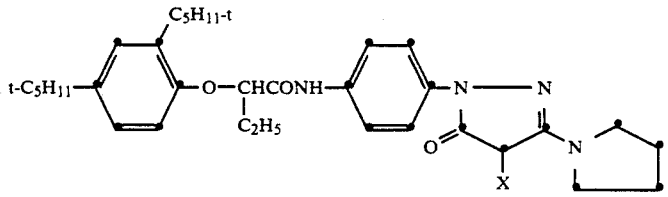

X = PMT$^-$

-continued

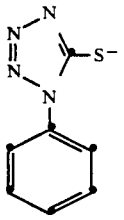

PMT

The results of the tests are shown in the attached Table 1.

TABLE 1

| Example Emulsion | SE (ng/m$^2$) | IR (ng/m$^2$) | Dmin[a] | .15 Speed[b] | Gamma | Reciprocity[c] | Pressure[d] |
|---|---|---|---|---|---|---|---|
| 1 | 0 | 0 | .15 | 254 | 1.12 | 38 | −.135 |
| 2 | 0 | 33 | .19 | 234 | 1.23 | 5 | −.095 |
| 3 | 0 | 8.3 | .16 | 243 | 1.22 | 10 | −.065 |
| 4 | 184 | 0 | .17 | 259 | 1.23 | 15 | −.04 |
| 5 | 184 | 33 | .19 | 255 | 1.28 | 4 | −.04 |
| 6 | 184 | 8.3 | .17 | 263 | 1.31 | 7 | −.035 |

[a]Density Units
[b]Speed at a density of 0.15 above Dmin for a 1/100 second exposure (1 − log H) × 100 H = intensity × time
[c]Reciprocity = Difference of .15 Speed at 1/1000 sec. and 10 sec. exposure, (log H × 100)
[d]Pressure = Density difference between a coating which has received an applied pressure of 10,000 psi and an unpressurized coating, for an exposure value which results in a density of 1.0 on the unpressurized coating.

The above Table I clearly shows the desirable improvement whereby the speed of the emulsion is maintained, contrast (gamma) is increased, reciprocity failure is decreased, and pressure sensitivity is decreased by the preferred combination of iridium and selenium dopants of the invention.

We claim:

1. A process of forming silver halide emulsions comprising preparing a solution of water and peptizer adding a soluble halide salt and a soluble silver salt to said solution to form silver halide grains after greater than half of the total silver to be precipitated has been added to said solution adding during growth of said silver halide grains iridium and selenium in an amount effective to decrease reciprocity failure with substantially no decrease in speed in films formed from said grains compared with similar silver halide grains not containing iridium and selenium.

2. The process of claim 1 wherein said iridium is added in an amount of between about 3 ng and about 88 ng per square meter of surface area of the silver halide grains.

3. The process of claim 1 wherein said selenium is added in an amount of between about 42 ng and about 487 ng per square meter of surface area of the silver halide grains.

4. The process of claim 3 wherein said selenium is added in an amount of between about 84 and about 244 nanograms.

5. The process of claim 1 wherein said iridium is added after about 70 weight percent of the silver weight has been added.

6. The process of claim 1 wherein said selenium is added immediately subsequent to iridium addition.

7. The process of claim 1 wherein said silver halide grains are greater than 70% tabular grains with a diameter to thickness ratio of greater than 8.

8. The process of claim 7 wherein the pBr of the solution during ripening and growth is well above the pBr during nucleation.

9. The process of claim 1 wherein said halide salt comprises greater than about 88 percent of a bromide salt and the remainder an iodide salt.

10. The process of claim 9 wherein said bromide salt comprises greater than about 94 percent.

11. The process of claim 1 wherein said iridium is added to said solution after between about 70 and about 95 weight percent of the silver has been added and wherein said selenium is added immediately subsequent to iridium addition.

12. A photographic element comprising at least one layer comprising an emulsion of silver bromoiodide grains having incorporated into said grains during precipitation about 3 to about 88 ng of iridium per square meter silver halide grain surface area and about 42 to about 487 ng of selenium per square meter of silver halide grains surface area.

13. The element of claim 12 wherein said silver halide grains comprise less than about 12 weight percent iodide and the remainder bromide.

14. The element of claim 13 further comprising a substrate.

15. The element of claim 13 wherein said emulsion silver halide comprises less than 6 percent iodide.

16. The element of claim 12 wherein said element has a reciprocity of less than 0.15 Log H between the exposure times of 1/1000 and 10 seconds.

17. The element of claim 12 wherein said iridium is incorporated into said grain so as to be present at about 8 ng per square meter of silver halide surface area.

18. The element of claim 17 wherein said selenium is present in an amount of about 184 ng per square meter of silver halide surface area.

19. The element of claim 12 wherein said iridium and said selenium are incorporated into said grain after between about 70 and about 95 weight percent of the silver grain has been formed on said grain.

20. A process of forming a silver halide emulsions comprising preparing a solution of water and peptizer, adding a soluble halide salt and a soluble silver salt to said solution to precipitate silver halide grains, during addition of growth silver to said solution of water and peptizer adding iridium in amount of between about 3 ng and about 88 ng per square meter of surface area of the silver halide grains, and adding selenium in an amount of between about 42 ng and about 487 ng per square meter of surface area of the silver halide grains to decrease reciprocity failure with substantially no decrease in speed in films formed from said grains.

21. The process of claim 20 wherein said iridium is added after about 70 weight percent of the silver weight has been added.

22. The process of claim 21 wherein said selenium is added immediately subsequent to iridium addition.

23. The method of claim 21 wherein said halide salt comprises greater than about 88 percent of a bromide salt and the remainder an iodide salt.

24. The process of claim 23 wherein said bromide salt comprises greater than about 94 percent.

25. The process of claim 20 wherein said silver halide grains are greater than 70% tabular grains with a diameter to thickness ratio of greater than 8.

26. The process of claim 25 wherein the pBr of the solution during ripening and growth is well above the pBr during nucleation.

27. The process of claim 20 wherein said selenium is added in an amount of between about 84 and about 244 nanograms.

28. The process of claim 20 wherein said iridium is added to said solution after between about 70 and about 95 weight percent of the silver has been added and wherein said selenium is added immediately subsequent to iridium addition.

* * * * *

UNITED STATES PATENT AND TRADEMARK OFFICE

CERTIFICATE OF CORRECTION

PATENT NO. : 5,164,292
DATED : November 17, 1992
INVENTOR(S) : Brian R. Johnson, et. al.

It is certified that error appears in the above-indentified patent and that said Letters Patent is hereby corrected as shown below:

Column 10, line 1, change "method" to --process--.

Signed and Sealed this

Nineteenth Day of October, 1993

*Attest:*

*Attesting Officer*

BRUCE LEHMAN

*Commissioner of Patents and Trademarks*